United States Patent [19]

Fröhling et al.

[11] 4,114,777

[45] Sep. 19, 1978

[54] FOLDED CIGARETTE BOX

[75] Inventors: Hans-Joachim Fröhling, Hamburg; Werner Rothe, Rellingen, both of Fed. Rep. of Germany

[73] Assignee: H. F. & Ph. F. Reemtsma, Hamburg, Fed. Rep. of Germany

[21] Appl. No.: 845,830

[22] Filed: Oct. 26, 1977

[30] Foreign Application Priority Data

Oct. 30, 1976 [DE] Fed. Rep. of Germany ..... 2650195
Dec. 4, 1976 [DE] Fed. Rep. of Germany ..... 2655113

[51] Int. Cl.[2] ..... B65D 5/66
[52] U.S. Cl. ..... 229/44 CB
[58] Field of Search ..... 229/44 CB

[56] References Cited

U.S. PATENT DOCUMENTS

| | | | |
|---|---|---|---|
| 2,963,214 | 12/1960 | Leome et al. | 229/44 CB |
| 3,351,267 | 11/1967 | Jackson | 229/44 CB |
| 3,979,047 | 9/1976 | Focke et al. | 229/44 CB |

*Primary Examiner*—Davis T. Moorhead
*Attorney, Agent, or Firm*—Cushman, Darby & Cushman

[57] ABSTRACT

A folded cigarette box having a hinged lid is made from a single blank having cutout portions, some of which form some of the exterior walls of the box and others of which form interior wall flaps which are of reduced size relative to the exterior wall portions but which are located so that the resulting cigarette package has the same rigidity as packages incorporating a greater quantity of material in the original blank.

6 Claims, 6 Drawing Figures

FOLDED CIGARETTE BOX

BACKGROUND AND SUMMARY OF THE INVENTION

The present invention relates to the containers for cigarettes of the type that are formed from a blank that is cut from sheet material and then folded to form an enclosure where a hinged lid is provided at one end of the box-like container.

Such lidded containers as is disclosed in U.S. Pat. No. 2,963,214 have long been known and have enjoyed widespread use. In general they are formed from a blank cut from sheet material which is then folded by automatic handling machinery to a point where the container is partially formed. Then, the cigarette product which has previously been wrapped in flexible sheet material is inserted into the partially formed container and the container forming steps are then carried out to completely enclose the product. Such containers have, in general, included a body portion having a front wall, bottom wall, rear wall and side walls, while the lid portion has likewise comprised a plurality of walls which are generally described as front, rear and top as well as side walls, all of which are of substantially less dimensions than the walls of the body of the container. In prior structures, a number of flaps have been retained when the blank is formed and which protrude from portions of the walls of the lid and body to assist in imparting rigidity to the resulting container when it is completely formed. In some cases, a double-walled structure is produced after the various folding steps have been carried out so that when the walls are glued together, a fairly rigid structure is achieved.

In some arrangements, when such a package or container is opened, a separation between the front or forward wall of the body and the front wall of the lid is necessary to gain access to the product. In other arrangements, the blanks that have been formed have not been suitable for automatic packaging machines, particularly where cigarettes are the product because of the requirement that the package be completely formed after the product is received in the partially formed container.

One type of so-called hinge-lid box such as disclosed in German Publication No. 2,426,131, has gained wide commercial acceptance, it is believed, because the front wall of the body of the box is not connected in any way to the front wall of the lid by a folding edge. Instead, containers of this type are formed with the various walls of the body and lid in sequence so that the corresponding flaps of the walls all lie inside or outside of the container and extend the full width of the container, thus resulting in a very rigid box. However, such blanks are expensive because of the large consumption of high-grade material for the blanks and it is an object of the present invention to provide a container where the blank will consist of at least 10 percent less sheet material, thereby resulting in a considerable saving in view of the rising price of paper stock. Yet, the resulting container, according to the present invention, will have substantial rigidity as required for the products.

In a preferred embodiment, a uniform blank for forming the hinge-lid box of the present invention is produced in the customary manner by punching and folding devices but where some of the side flaps which extend from portions of the walls of the hinge lid and body are considerably reduced in width but are so located as to contribute to the overall rigidity of the structure if not actually improving the integrity of the resulting container. In one embodiment, only the front wall of the body and the front wall of the lid have side flaps which extend the entire width of the container to define the side walls thereof and the remaining flaps, all of which are located on the interior of the container when fully formed, are substantially reduced in size thereby resulting in the conservation mentioned above.

Other patents relating to the field of the present invention are U.S. Pat. No. 2,369,385 and British Pat. No. 1,217,558 of Dec. 31, 1970.

As will be apparent from a consideration of the detailed description that follows, the hinge lid package of the present invention can be constructed with substantially less material than was heretofore possible and yet will submit to handling by the conventional packaging machinery while exhibiting the necessary rigidity for packages of this type.

These and other advantages will become apparent as consideration is given to the following detailed description and accompanying drawings, in which:

DETAILED DESCRIPTION OF THE INVENTION

Figure 1:
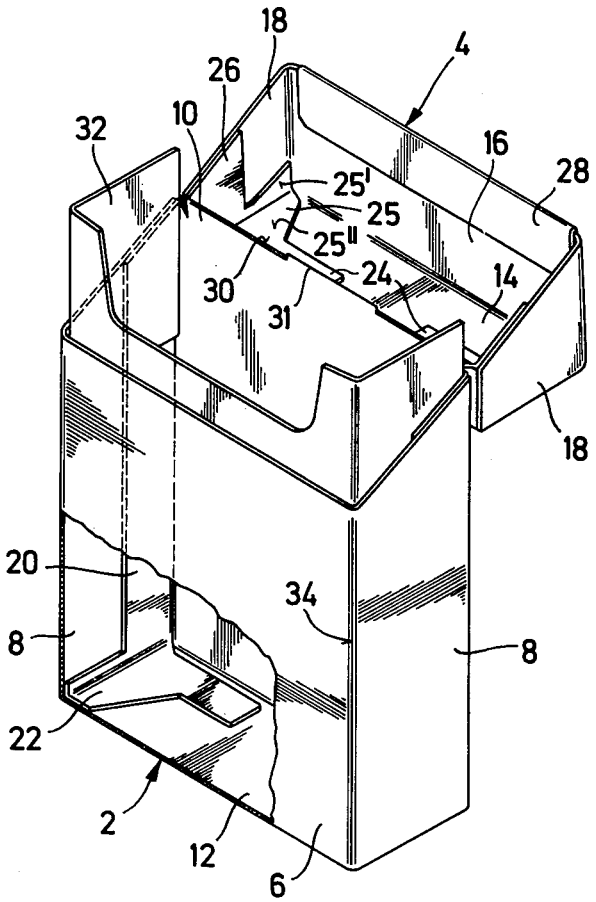
FIG. 1 is a perspective view with parts broken away showing the completed container of the present invention.

Referring to FIG. 1, there is shown a hinge lid box 2 which consists of a body with a lid 4 formed by folding and gluing portions of a blank. A collar insert 32 is glued into the body of the box 2. The body of the box 2 has a forward wall 6, a bottom wall 12, a rear wall 10, while the lid 4 consists of a rear wall 11, a top wall 14 and a front wall 16. The front wall 6 of the body of the box 2 has side flaps 8 and the rear wall 10 has side flaps as at 22 and 20.

Figure 2:
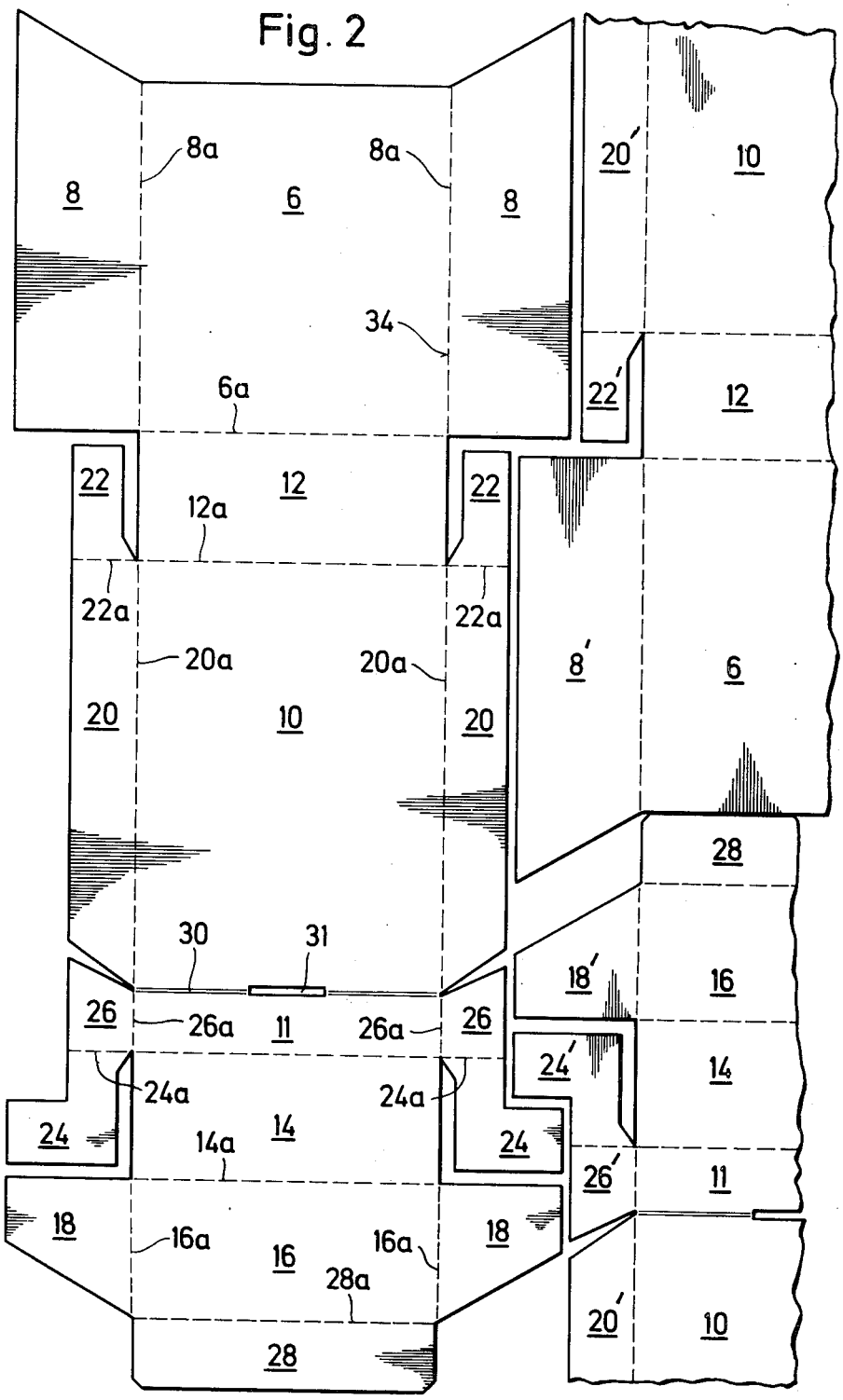
FIG. 2 is a plan view of a blank illustrating the relative dimensions of the flaps extending from the front and back panels of the body and lid.

The lid rear wall 11 has side flaps 26, both of which are shown in FIG. 2, from which extend flaps 24. Side flaps 18 extend from the front wall 16 of the lid 4.

In the construction of the box, the two side flaps 8 are folded back from the front wall 6 substantially at right angles to the front wall 6. When using a blank as viewed in FIG. 2, or preparing a hinge lid box similar to the box 2 of FIG. 1. this folding occurs along the lines 8*a*. Then the front wall 6 is folded around line 6*a* at right angles to section 12 and then the thus folded sections are folded about line 12*a* and the side flaps 20 of the rear wall 10 are folded at right angles to the rear wall 10 along lines 20*a*. The flaps 22 extending from flaps 20 are folded around the lines 22*a* and these flaps 22 are glued to the bottom wall 12. Also, the side of the flaps 20 facing the inside surface of the flaps 8 are glued so that the flaps 20 are enclosed within the box 2 as shown in FIG. 1.

The hinge of the lid 4 is located at the folding edge 30 which acts as a joint which, to facilitate the hinging action, may be provided wth an incision as at 31. The rear wall 11 of the lid 4 is, in such circumstances, actually an extension of the rear wall 10 of the body of the box 2 and is co-planar with the rear wall 10 when the lid is closed. The top wall 14 of the lid 4 is formed by bending about the line 24*a* which also divides side flaps 26 from side flaps 24 on either side of the lid 4. The front wall 16 is formed by bending the front wall 16 about line 14*a* and the exterior side panels of the lid 4 are formed by bending side flaps 18 around lines 16*a*. The surfaces of the side flaps 26 are glued to the inside facing surfaces of the side flaps 18 while the outside facing surfaces of the flaps 24 are glued to the inside facing surface of the top wall 14. Similarly, the inside of flap 28 is glued to the inside surface of front wall 16 of the lid 4 to provide a reinforcement for the front edge of the lid.

The above described steps in the construction of the box 2 with the folding and gluing of the various walls and corresponding flaps are in general similar to the steps that have been employed in constructing cigarette packages of the hinged lid type that have been used for many years. However, it should be noted that only the side flaps 8 and 18 have a width that corresponds to the total thickness of the final container. Also, the actual step of packaging cigarettes within the container or box 2 takes place utilizing the container of the present invention in the same manner as has been employed with the containers of the prior art. Specifically, it is the practice to form a block of 20 cigarettes which are wrapped in aluminum foil or the like at a packaging station and to transport the wrapped cigarettes to the blank and to deposit the wrapped cigarettes on the rear wall 10. Subsequent thereto, the remaining wall parts and flaps of the box 2 are folded in succession and glued to enclose the wrapped cigarettes which have previously been deposited on the rear wall 10.

It should be noted that the flaps 22 as shown in FIG. 2 adjacent the bottom wall 12 and the flaps 20 extending from the rear wall 10, as well as the flaps 26 extending from the rear wall 11 of the lid 4, are reduced in width as measured by their perpendicular distance from an axis running parallel to the folding line 34, for example. The flaps 24 which extend from the reduced width flaps 26 are only slightly reduced in width in absolute terms by the gap that exists between the inner edges of the flaps 24 and the immediately adjacent edge of the top wall 14 of the lid 4.

As shown in FIG. 2, an overall saving in storage space is achieved with blanks of this embodiment since an adjacent blank, rotated 180 degrees and lying in the same plane as the adjacent blank will occupy a total surface area that is reduced by virtue of the reduced width of the flaps 22, 20 and 26 since the full width flaps 8′ and 18′ of the immediately adjacent blank will, as illustrated in FIG. 2, mesh with the areas unoccupied by the reduced width flaps of the adjacent blank.

It will be apparent that with a blank as structured in FIG. 2, portions of the reduced width blanks will remain exposed such as where the blank 24 is glued to the inner face of the wall 14 of the lid 4. Obviously, however, as is well known in this art, since the product to be contained within the box 2 will be enclosed within a lining such as an aluminum foil, such exposed surfaces will have no effect.

Figure 3:
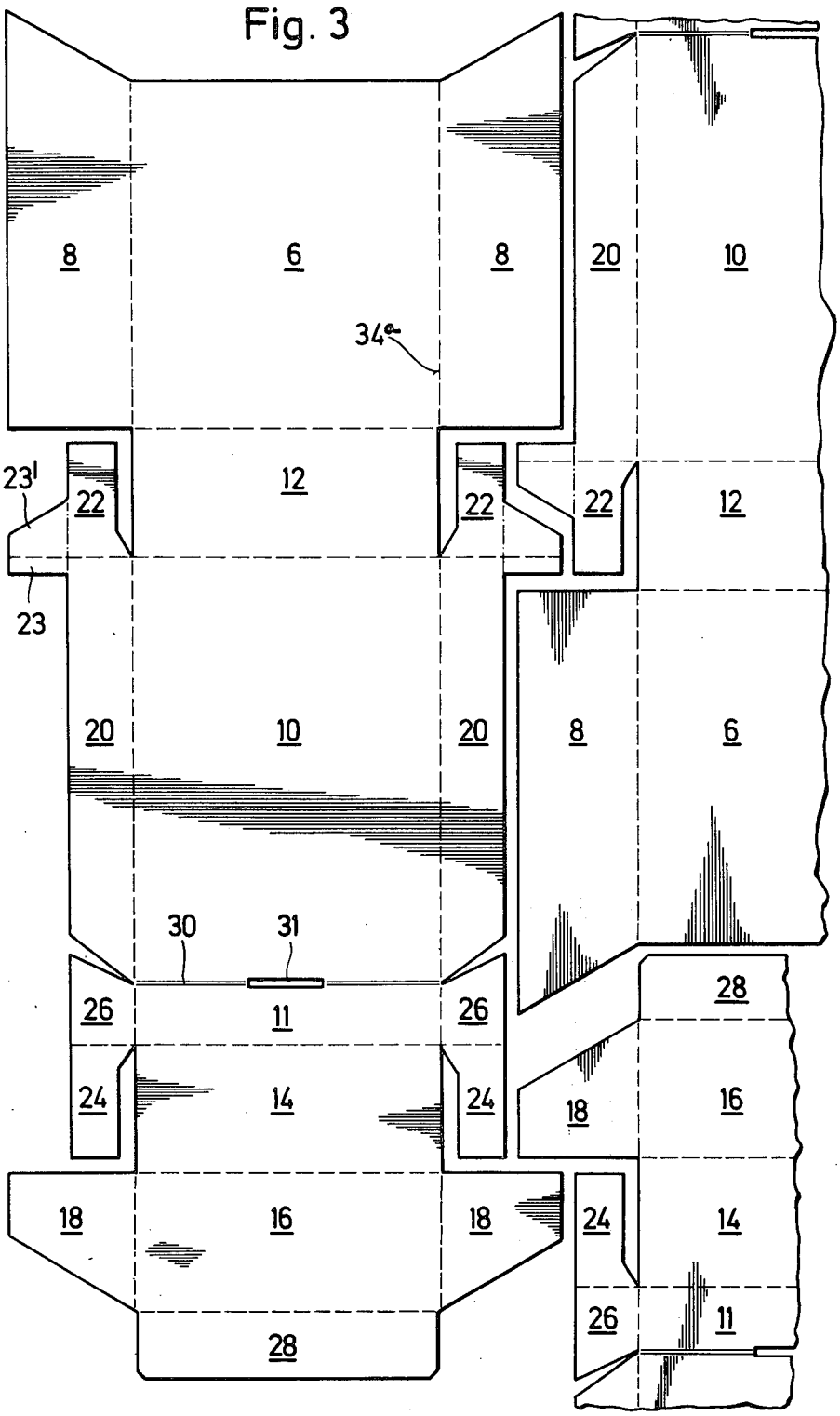
FIG. 3 shows an alternate embodiment of the blank of FIG. 2.

Turning now to FIG. 3, there are illustrated one full blank and an adjacent blank designated by primed numerals which also is designed to conserve more storage space than in the case of blanks of the prior art packages.

It will be appreciated that the blank designated by the primed numerals in FIGS. 2 and 3 are identical to the blank bearing the unprimed numerals and that such blanks may be made by suitable cutting dies extended over the width of a sheet of material where the dies are rotated 180 degrees relative to an adjacent die.

In FIG. 3, there is illustrated an embodiment of the present invention which is distinguished by the fact that the flaps 24*a*, which correspond roughly in location to the flaps 24 of the embodiment of FIG. 2, have been reduced in their width from about one-third to two-thirds relative to the full width flaps 8*a* and 18*a* so that the outer edges of the flaps 20*a*, 26*a* and 24*a* all lie along a line that extends parallel to the primary folding edges such as at 34*a*. Portions of the flaps 22*a*, however, still extend substantially the full width as at 23*a* and 23′.

With this arrangement, adjacent blanks such as is illustrated in FIG. 3, can be placed close together with a space saving corresponding to the reduced width of the flaps 20*a*, 26 and 24*a* and the bevelled shape given to the full width flaps 23′ will accommodate the corresponding flap on an adjacent blank which has been rotated 180° in the plane in which the blanks are situated. Thus, even though the flap portions 23′ extend the full width, a space saving is still achieved due to the partly bevelled shape of the flat sections 23′.

In the arrangement of FIGS. 2 and 3, it should also be noted that the blanks on the left in these figures are each offset approximately the distance of one wall, 6*a* or 10*a*, relative to the adjacent blank. That is, the front wall 6 or 6*a* is aligned with the rear wall 10 or 10*a* of the adjacent blank.

Figure 4:
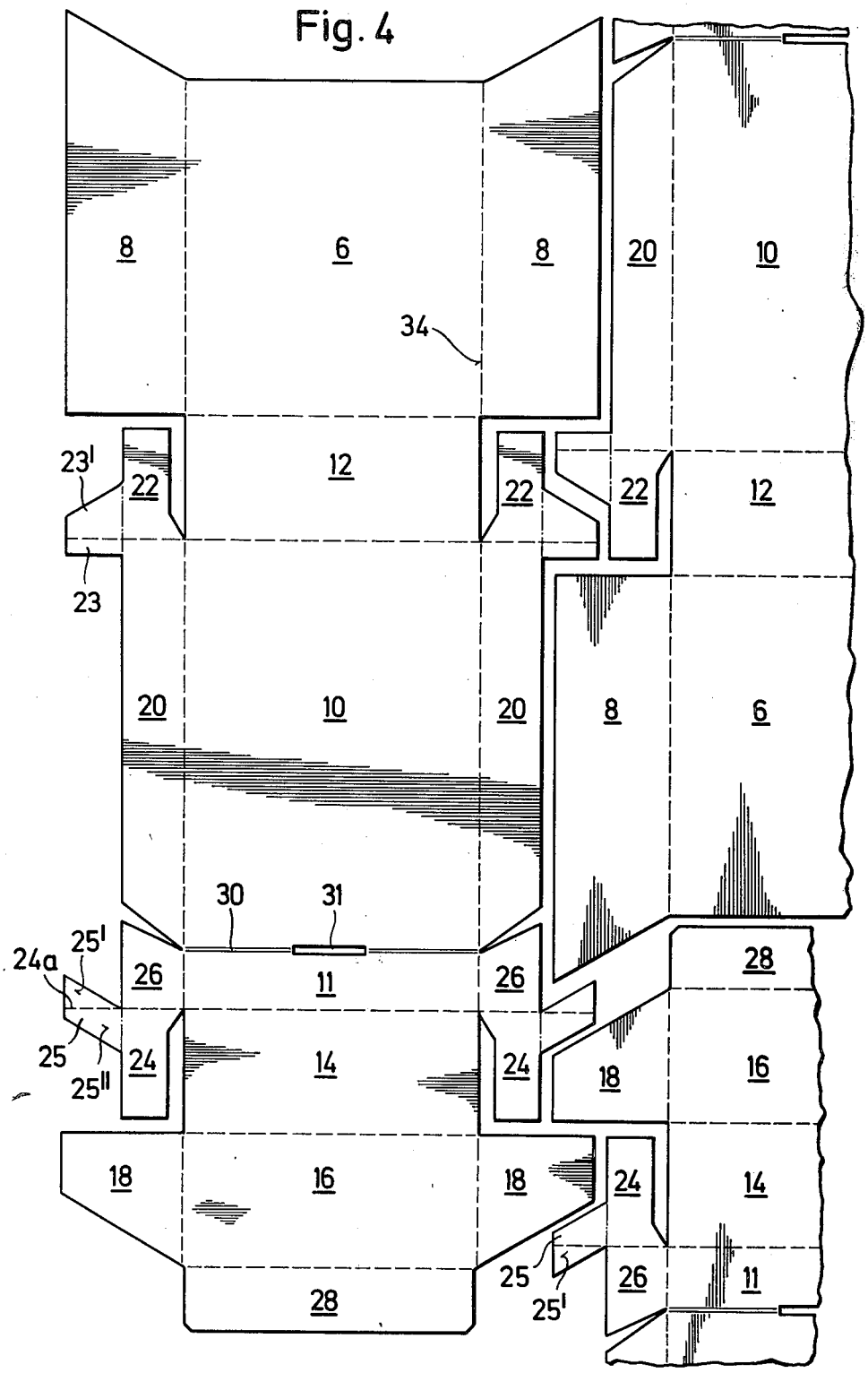
FIG. 4 shows another embodiment of the blank from which the container of the present invention is formed.

Turning to FIG. 4, there is illustrated another embodiment which is distinguished from the previous embodiments in that the side flaps 26*b* and 24*b* which extend from the rear wall 11*b* of the lid are provided with oblique extending flaps which, in effect, extend the width of these flaps to a dimension corresponding to the width of the flaps 8*b* and 18*b*. To this end, the oblique extending flaps 25*b*′ and 25*b* extend from the side edge of flap 24*b* with section 25*b*′ extending on one side of a fold line 27*b* and with the other side 25*b*″ extending in the opposite direction. The entire flap designated 25*b* in the figure is rhomboid-shaped.

As illustrated, the rhomboid-shaped flap 25*b* will still permit a reduction in storage space since the flap will fit between the rhomboid spaces provided by the slanted cuts forming the lower edge of side panels 8*b*′ and 18*b*′ of adjacent blanks as illustrated in FIG. 4, each of which has been rotated 180° in the plane in which the blanks are situated.

This nesting of the blanks in a plane as illustrated in the figures is exaggerated for clarity and it will be understood by those skilled in the art that the spacing between the adjacent blanks and their intersected or nested flaps will be greatly reduced in actual practice.

In the arrangement of a container manufactured from a blank of FIG. 4 namely box 2 according to FIG. 1 it will be noted that there will be no open slits such as between edge 28*b* of flaps 18*b* and edge 29*b* of top wall 14*b* when the lid panels are folded since the hinge line 27*b* will span this slit or flasher as these openings are termed in this field.

Figure 5:
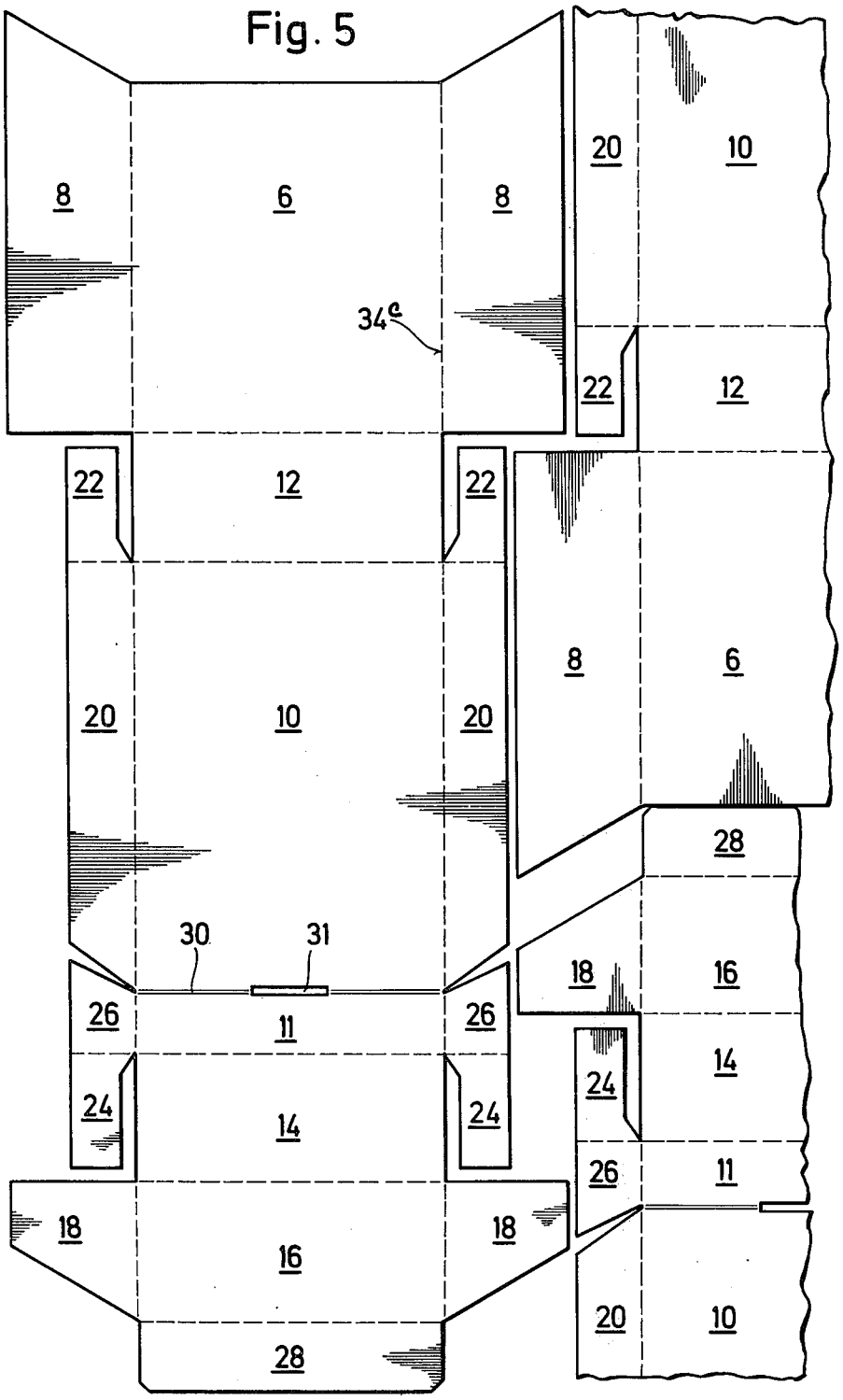
FIGS. 5 and 6 show alternate embodiments of the blanks of FIG. 4.

As can be seen in the embodiment of FIG. 5, the reduced width panels or flaps 20, 22, 24 and 26 have no extensions or projections as in the embodiments of FIGS. 2–4. With this arrangement, as illustrated in FIG. 5, the adjacent blanks may have their full width side panels such as at 8 and 18 inserted in the recess formed by the reduced width panels 20, 22 and 26. However, in the completed package, there will exist slits between the main folded flaps 8 and 18, called flashers as described above, but such open slits, as is conventional, will be bridged by the lining material that is used to package the product such as the aluminum foil for cigarettes.

Figure 6:
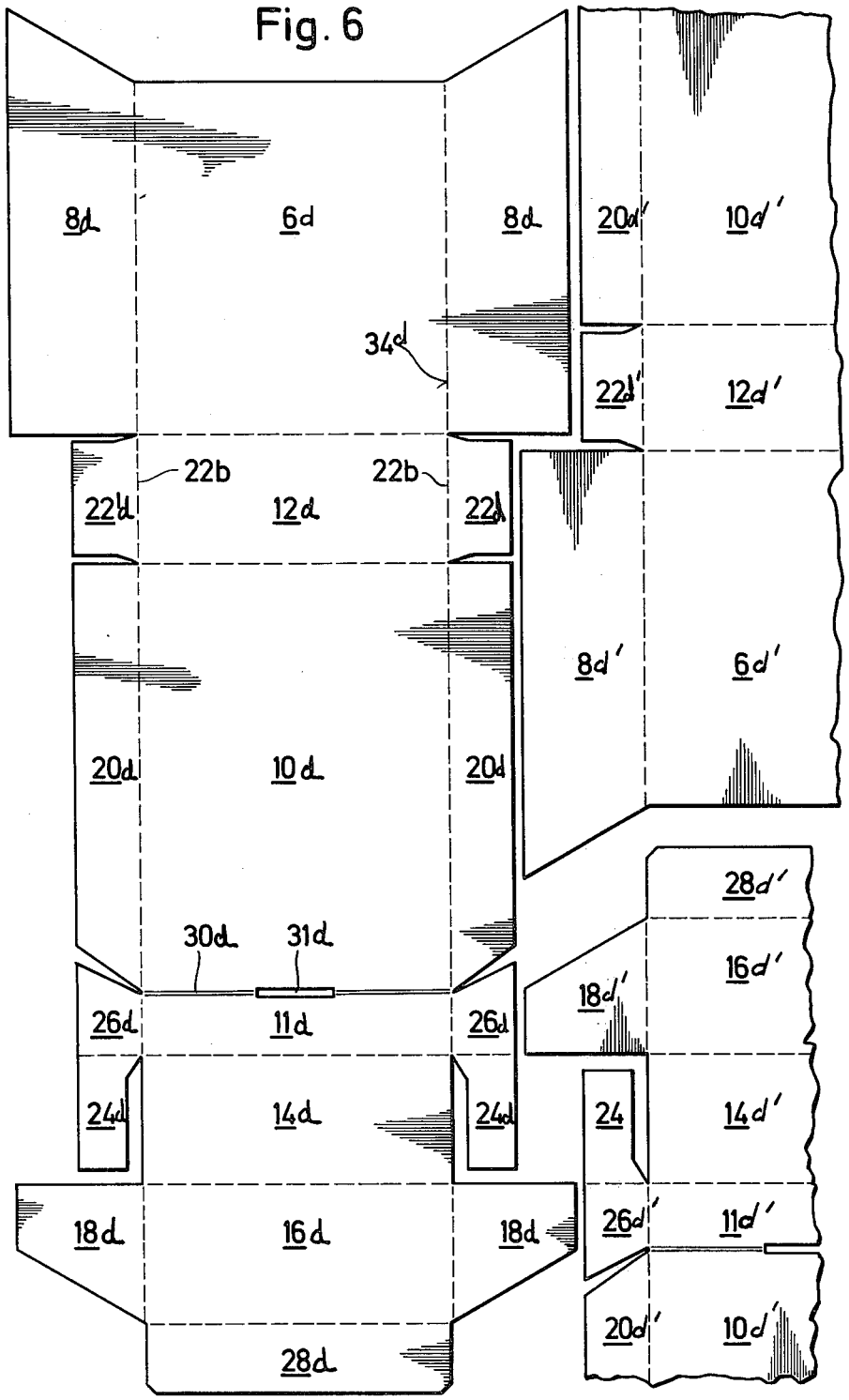

Turning now to the embodiment of FIG. 6, it will be seen that the flaps **20*d*, 26*d* and 24*d* are all completely reduced in their width along the line extending parallel to the main fold line 34*d* while the flap 22*d* of the bottom wall 12*d* is fully connected along the full width of the bottom wall 12*d*** as distinguished from the case in the previous embodiments.

Similarly, the flap **24*d* may be joined integrally along the corresponding length of the side edges of the top wall 14*d*** of the lid.

From the foregoing, it will be seen that a container having a hinged lid is obtained which serves that same function and has substantially the same appearance as containers previously developed in this art but one which requires less material for its production without sacrificing the required rigidity in the container.

Having described the invention, it will be apparent to those skilled in the art that modifications may be made thereto without departing from the spirit and scope of the present invention as defined in the appended claims.

What is claimed is:

1. A container having a body and a hinged lid for cigarettes or similar articles, said body being formed from a blank having a front wall, a bottom wall, a rear wall and a lid having a rear wall integrally hinged to the rear wall of the body, a lid front wall and a lid top wall, with folding edges between adjacent walls, some of said walls having side flaps projecting therefrom along associated folding edges and having a width dimension corrsponding to the full width of the completed container, others of said walls having side flaps having a width dimension that is reduced relative to said full width dimension and which extend from others of said walls such that said reduced width flaps are located on the interior of said completed container, said container being held together by adhesive bonding between said full width flaps and said reduced width flaps, at least one pair of said reduced width side flaps being provided with extending portions each having outer edges lying along a line that extends through the outer edges of said full width flaps.

2. The container as claimed in claim 1 wherein the reduced width of said reduced width flaps is between one-third to two-thirds of the width of said full width flaps.

3. A container having a hinge lid for cigarettes or similar articles which is formed from a blank and having a body including a front wall, a bottom wall and a rear wall and a lid having a front wall, top wall and rear wall hinged to the rear wall of said body, said front wall of said body having a side flap extending from opposite sides thereof, said side flaps of said front wall having a width corresponding to the full width of said completed container, said front wall of said lid having side flaps extending from opposite sides thereof, said side flaps of said front wall of said lid having a width corresponding to said full width of the completed container, the remaining walls of said body and said lid having a side flap extending from opposite sides thereof but having a width that is reduced relative to said full width dimension, one of said flaps adjacent said bottom wall of said body having an extension which has an edge which extends obliquely from said reduced side flap from which it extends to a dimension corresponding to said full width dimension.

4. The container as claimed in claim 3 wherein said reduced width side flaps adjacent said rear wall of said lid each have rhomboid-shaped projections each extending a perpendicular distance from the edge of said rear wall of said lid corresponding to the full width dimension of the completed container.

5. The container as claimed in claim 4 wherein said rhomboid-shaped projections are divided by a fold edge into a triangular-shaped panel and a trapezoidal-shaped panel.

6. The container as claimed in claim 3 wherein said bottom wall of said body has side flaps extending from opposite sides thereof, said rear wall of said body has side flaps extending from opposite sides thereof, said rear wall of said lid has side flaps extending from opposite sides thereof and said side flaps extending from said rear wall of said lid has flaps extending therefrom and all of said flaps are of reduced width relative to the full width of said completed container.

* * * * *